US005078808A

United States Patent [19]

Schoen

[11] Patent Number: 5,078,808

[45] Date of Patent: Jan. 7, 1992

[54] METHOD OF MAKING REGULAR GRAIN ORIENTED SILICON STEEL WITHOUT A HOT BAND ANNEAL

[75] Inventor: Jerry W. Schoen, Middletown, Ohio

[73] Assignee: Armco Inc., Middletown, Ohio

[21] Appl. No.: 549,615

[22] Filed: Jul. 9, 1990

[51] Int. Cl.[5] ..... C21D 8/02

[52] U.S. Cl. ..... 148/12 A; 148/111

[58] Field of Search ..... 148/111, 112, 173, 12 A, 148/12.4

[56] References Cited

U.S. PATENT DOCUMENTS 3,021,237 2/1962 Henke ..... 148/12 A 4,390,378 6/1983 Rastogi ..... 148/12 A

FOREIGN PATENT DOCUMENTS 59-190324 10/1984 Japan ..... 148/112

*Primary Examiner*—Deborah Yee

*Attorney, Agent, or Firm*—Frost & Jacobs

[57] ABSTRACT

A process of producing regular grain oriented silicon steel having a final thickness of from 7 mils (0.18 mm) to about 18 mils (0.45 mm) including the steps of providing a silicon steel hot band, removing hot band scale, cold rolling to intermediate gauge without an anneal of the hot band, performing an intermediate anneal at a soak temperature of about 1650° F. (900° C.) to about 1700° F. (9300° C.), subjecting said annealed silicon steel to a first stage slow cooling at a rate of about 500° F. (260° C.) to about 1050° F. (585° C.) per minute down to about 1100° F.±50° F. (595° C.±30° C.), thereafter subjecting said silicon steel to a second stage fast cooling down to from about 600°F. (315° C.) to about 1000° F. (540° C.) at a cooling rate of from about 25° F. (1390° C.) to about 3500° F. (1945° C.) per minute followed by a water quench, cold rolling to final gauge, decarburizing, applying an annealing separator and final annealing.

11 Claims, 1 Drawing Sheet

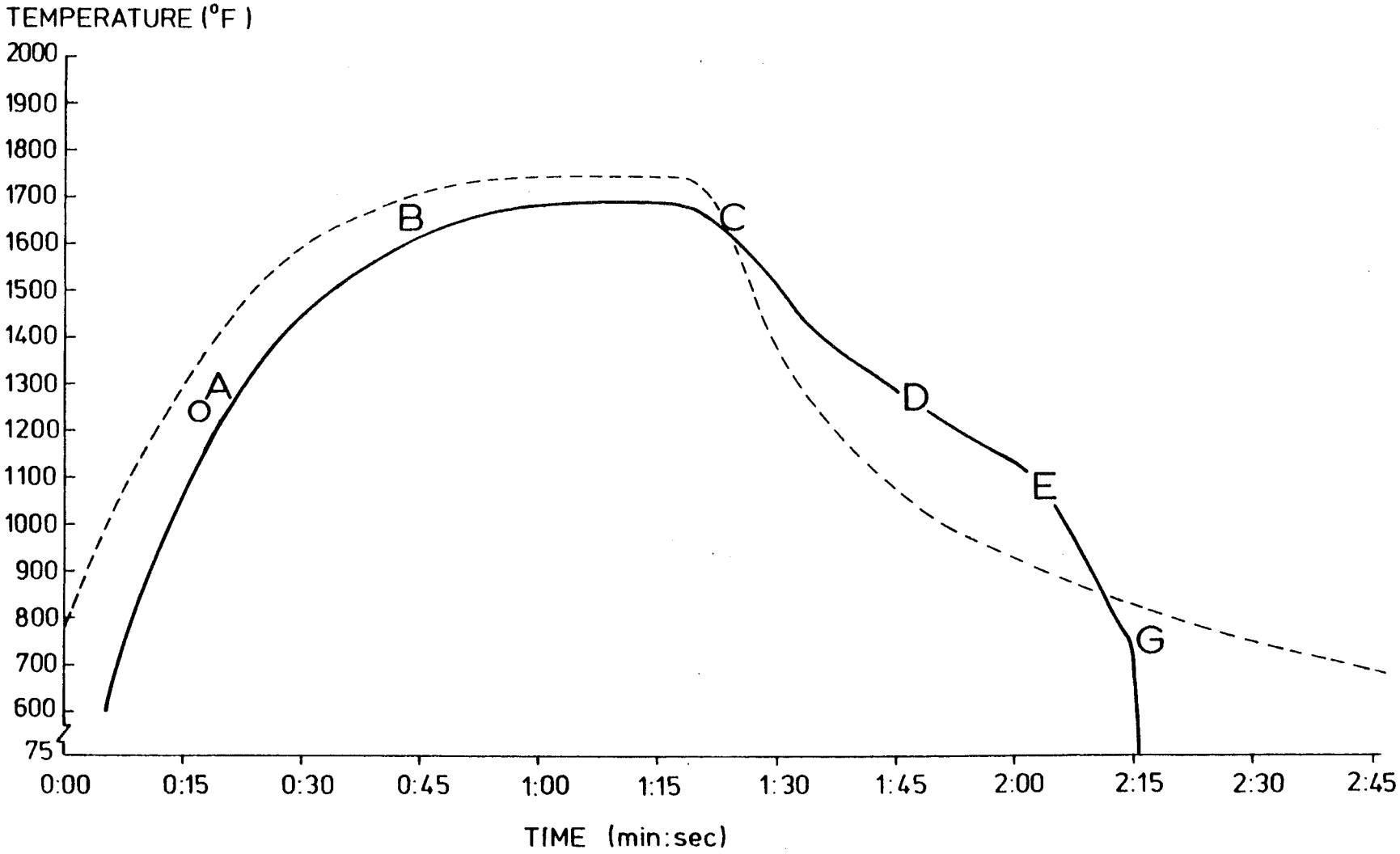
TEMPERATURE (°F)
2000
1900
1800
1700
1600
1500
1400
1300
1200
1100
1000
900
800
700
600
75
0:00
0:15
0:30
0:45
1:00
1:15
1:30
1:45
2:00
2:15
2:30
2:45
TIME (min:sec)
A
B
C
D
E
G

METHOD OF MAKING REGULAR GRAIN ORIENTED SILICON STEEL WITHOUT A HOT BAND ANNEAL

TECHNICAL FIELD

The present invention relates to a process of producing regular grain oriented silicon steel in thicknesses ranging from about 18 mils (0.45 mm) to about 7 mils (0.18 mm) without a hot band anneal, and to such a process wherein the intermediate anneal following the first cold rolling stage has a very short soak time and a two-part temperature-controlled cooling cycle to control carbide precipitation.

BACKGROUND ART

The teachings of the present invention are applied to silicon steel having a cube-on-edge orientation, designated (110) [001] by Miller's Indices. Such silicon steels are generally referred to as grain oriented silicon steels. Grain oriented silicon steels are divided into two basic categories: regular grain oriented silicon steel and high permeability grain oriented silicon steel. Regular grain oriented silicon steel utilizes manganese and sulfur (and/or selenium) as the principle grain growth inhibitor and generally has a permeability at 796 A/m of less than 1870. High permeability silicon steel relies on aluminum nitrides, boron nitrides or other species known in the art made in addition to or in place of manganese sulphides and/or selenides as grain growth inhibitors and has a permeability greater than 1870. The teachings of the present invention are applicable to regular grain oriented silicon steel.

Conventional processing of regular grain oriented silicon steel comprises the steps of preparing a melt of silicon steel in conventional facilities, refining and casting the silicon steel in the form of ingots or strand cast slabs. The cast silicon steel preferably contains in weight percent less than about 0.1% carbon, about 0.025% to about 0.25% manganese, about 0.01% to 0.035% sulfur and/or selenium, about 2.5% to about 4.0% silicon with an aim silicon content of about 3.15%, less than about 50 ppm nitrogen and less than about 100 ppm total aluminum, the balance being essentially iron. Additions of boron and/or copper can be made, if desired.

If cast into ingots, the steel is hot rolled into slabs or directly rolled from ingots to strip. If continuous cast, the slabs may be pre-rolled in accordance with U.S. Pat. No 4,718,951. If developed commercially, strip casting would also benefit from the process of the present invention. The slabs are hot rolled at 2550° F. (1400° C.) to hot band thickness and are subjected to a hot band anneal of about 1850° F. (1010° C.) with a soak of about 30 seconds. The hot band is air cooled to ambient temperature. Thereafter, the material is cold rolled to intermediate gauge and subjected to an intermediate anneal at a temperature of about 1740° F. (950° C.) with a 30 second soak and is cooled as by air cooling to ambient temperature. Following the intermediate anneal, silicon steel is cold rolled to final gauge. The silicon steel at final gauge is subjected to a conventional decarburizing anneal which serves to recrystallize the steel, to reduce the carbon content to a non-aging level and to form a fayalite surface oxide. The decarburizing anneal is generally conducted at a temperature of from about 1525° to about 1550° F. (about 830° to about 845° C.) in a wet hydrogen bearing atmosphere for a time sufficient to bring the carbon content down to about 0.003% or lower. Thereafter, the silicon steel is coated with an annealing separator such as magnesia and is box annealed at a temperature of about 2200° F. (1200° C.) for twenty-four hours. This final anneal brings about secondary recrystallization. A forsterite or "mill" glass coating is formed by reaction of the fayalite layer with the separator coating.

Representative processes for producing regular grain oriented (cube-on-edge) silicon steel are taught in U.S. Pat. Nos. 4,202,711; 3,764,406; and 3,843,422.

The present invention is based upon the discovery that in the conventional routing given above, the hot band anneal can be eliminated if the intermediate anneal and cooling practice of the present invention is followed. The intermediate anneal and cooling procedure of the present invention contemplates a very short soak preferably at lower temperatures, together with a temperature controlled, two-stage cooling cycle, as will be fully described hereinafter.

The teachings of the present invention yield a number of advantages over the prior art. At all final gauges within the above stated range, magnetic quality is achieved which is at least equal to and often better than that achieved by the conventional routing. The magnetic quality is also more consistent. The teachings of the present invention shorten the annealing cycle by from 20% or more, thereby increasing line capacity. The process of the present invention enables for the first time the manufacture of thin gauge, typically about 9 mils (0.23 mm) to about 7 mils (0.18 mm), regular grain oriented silicon steel having good magnetic characteristics without a hot band anneal following hot rolling to hot band. This enables thin gauge regular grain oriented silicon steel to be manufactured where hot band annealing can not be practiced. The lower temperature of the intermediate anneal of the present invention increases the mechanical strength of the silicon steel during the anneal, which previously was marginal at high annealing temperatures.

European Patent No. 0047129 teaches the use of rapid cooling from 1300° to 400° F. (705° to 205° C.) for the production of high permeability electrical steel. This rapid cooling enables the achievement of smaller secondary grain size in the final product. U.S. Pat. No. 4,517,932 teaches rapid cooling and controlled carbon loss in the intermediate anneal for the production of high permeability electrical steel, including an aging treatment at 200° to 400° F. (95° to 205° C.) for from 10 to 60 seconds to condition the carbide.

These high permeability silicon steel references employ a very low temperature and lengthy intermediate anneal cycle having a 120 second soak at 1600° F. (870° C.) followed by rapid cooling from 1300° F. (705° C.) and an aging treatment to condition the carbide precipitates. It has been found, however, that in the intermediate anneal of the present invention, rapid cooling from above about 1150° F. (620° C.) or higher produces poorer magnetic quality owing to the formation of martensite which increases hardness, degrades mechanical properties for subsequent cold rolling, and contributes to poorer magnetic quality in the final product.

In the above-noted U.S. Pat. No. 4,517,032, a low temperature aging treatment following rapid cooling is employed. This practice, if used for regular grain oriented materials, has been found to produce enlarged secondary grain size and poorer magnetic quality in the final product since it impaires the fine iron carbide precipitates. Lower temperature annealing at about 1640° F. (895° C.) or lower, to avoid the formation of austenite, could be used to provide adequate solution of iron carbide without forming a second phase which must be conditioned out of the microstructure. However, this procedure requires much longer annealing times to effect carbide solution. Such a procedure would permit direct rapid cooling from soak temperature without the two-stage cooling cycle of the present invention.

U.S. Pat. No. 4,478,653 teaches that a higher intermediate anneal temperature can be used to produce 9 mil (0.23 mm) regular grain oriented silicon steel without hot band annealing. It has been found, however, that 9 mil (0.23 mm) regular grain oriented silicon steel made in accordance with this patent has more variable magnetic quality than when a routing utilizing a hot band anneal is used. It has further been found that the no hot band anneal-high temperature intermediate anneal practice taught in this reference provides generally poor magnetic quality at thinner gauges of 9 mils (0.23 mm) or less, when compared to the above noted practice employing a hot band anneal. Finally, the very high temperature of the intermediate anneal of U.S. Pat. No. 4,478,653 results in low mechanical strength of the silicon steel, making processing more difficult.

DISCLOSURE OF THE INVENTION

According to the invention, there is provided a method for processing regular grain oriented silicon steel having a thickness in the range of from about 18 mils (0.45 mm) to about 7 mils (0.18 mm) comprising the steps of providing silicon steel consisting essentially of, in weight percent, of less than about 0.1% carbon, about 0.025% to 0.25% manganese, about 0.01% to 0.035% sulfur and/or selenium, about 2.5% to 4.0% silicon, less than about 100 ppm total aluminum, less than about 50 ppm nitrogen, the balance being essentially iron. Additions of boron and/or copper can be made, if desired.

The silicon steel is cold rolled from hot band to intermediate thickness without a hot band anneal. The cold rolled intermediate thickness silicon steel is subjected to an intermediate anneal at about 1650° to about 2100° F. (about 900° to about 1150° C.) and preferably from about 1650° to about 1700° F. (from about 900° to about 930° C.) for a soak time of from about 1 to about 30 seconds, and preferably for about 3 to 8 seconds. Following this soak, the silicon steel is cooled in two stages. The first is a slow cooling stage from soak temperature to a temperature of from 1000° to 1200° F. (540° to 650° C.), and preferably to a temperature of 1100° F.±50° F. (595° C.±30° C.) at a rate less than about 1500° F. (835° C.) per minute, and preferably at a rate of from about 500° F. (280° C.) to 1050° F. (585° C.) per minute. The second stage is a fast cooling stage at a rate of greater than 1500° F. (835° C.) per minute, and preferably at a rate of 2500° to 3500° F. (1390° to 1945° C.) per minute followed by a water quench at about 600° to about 700° F. (about 315° to about 370° C.). Following the intermediate anneal, the silicon steel is cold rolled to final thickness, decarburized, coated with an annealing separator, and subjected to a final anneal to effect secondary recrystallization.

BRIEF DESCRIPTION OF THE DRAWING

The FIGURE is a graph illustrating the intermediate anneal time/temperature cycle of the present invention and that of a typical prior art intermediate anneal.

DESCRIPTION OF THE PREFERRED EMBODIMENTS

In the practice of the present invention, the routing for the regular grain oriented silicon steel is conventional and is the same as that given above with two exceptions. The first exception is that there is no hot band anneal. The second exception is the development of the intermediate anneal and cooling cycle of the present invention, following the first stage of cold rolling.

To this end, the starting material referred to as "hot band" can be produced by a number of methods known in the art such as ingot casting/continuous casting and hot rolling, or by strip casting. The silicon steel hot band scale is removed, but no hot band anneal prior to the first stage of cold rolling is practiced.

Following the first stage of cold rolling, the silicon steel is subjected to an intermediate anneal in accordance with the teachings of the present invention. Reference is made to the FIGURE, which is a schematic of the time/temperature cycle for the intermediate anneal of the present invention. The FIGURE also shows, with a broken line, the time/temperature cycle for a typical, prior art intermediate anneal.

A primary thrust of the present invention is the discovery that the intermediate anneal and its cooling cycle can be adjusted to provide a fine carbide dispersion. The refinement of the carbide enables production of regular grain oriented silicon steel over a wide range of melt carbon, even at final gauges of 7 mils (0.18 mm) and less, having good and consistent magnetic properties in the final product without the necessity of a hot band annealing step.

During the heat-up portion of the intermediate anneal, recrystallization occurs at about 1250° F. (675° C.), roughly 20 seconds after entering the furnace, after which normal grain growth occurs. The start of recrystallization is indicated at "O" in the FIGURE. Above about 1280° F. (690° C.) carbides will begin dissolving, as indicated at "A" in the FIGURE. This event continues and accelerates as the temperature increases. Above about 1650° F. (900° C.), a small amount of ferrite transforms to austenite. The austenite provides for more rapid solution of carbon and restricts normal grain growth, thereby establishing the intermediate annealed grain size. Prior art intermediate anneal practice provided a soak at about 1740° F. (950° C.) for a period of from 25 to 30 seconds. The intermediate anneal procedure of the present invention provides a soak time of from about 1 to 30 seconds, and preferably from about 3 to 8 seconds. The soak temperature has been determined not to be critical. The soak can be conducted at a temperature of from about 1650° F. (900° C.) to about 2100° F. (1150° C.). Preferably, the soak is conducted at a temperature of from about 1650° F. (900° C.) to about 1700° F. (930° C.), and more preferably at about 1680° F. (915° C.). The shorter soak time and the lower soak temperature are preferred because less austenite is formed. The austenite present in the form of dispersed islands at the prior ferrite grain boundaries is finer. Thus, the austenite is easier to decompose into ferrite with carbon in solid solution for subsequent precipitation of fine iron carbide. To extend either the soak temperature or time results in the enlargement of the austenite islands which rapidly become carbon-rich compared to the prior ferrite matrix. Both growth and carbon enrichment of the austenite hinder its decomposition during cooling. The desired structure exiting the furnace consists of a recrystallized matrix of ferrite having less than about 5% austenite uniformly dispersed throughout the material as fine islands. At the end of the anneal, the carbon will be in solid solution and ready for reprecipitation on cooling. The primary reason behind the redesign of the intermediate anneal time and temperature at soak is the control of the growth of the austenite islands. The lower temperature reduces the equilibrium volume fraction of austenite which forms. The shorter time reduces carbon diffusion, thereby inhibiting growth and undue enrichment of the austenite. The lower strip temperature, the reduced volume fraction and the finer morphology of the austenite makes it easier to decompose during the cooling cycle.

Immediately after the soak, the cooling cycle is initiated. The cooling cycle of the present invention contemplates two stages. The first stage extending from soak to the point "E" on the FIGURE is a slow cool from soak temperature to a temperature of from about 1000° F. (540° C.) to about 1200° F. (650° C.) and preferably to about 1100° F.±50° F. (595° C.±30° C.). This first slow cooling stage provides for the decomposition of austenite to carbon-saturated ferrite. Under equilibrium conditions, austenite decomposes to carbon-saturated ferrite between from about 1650° F. (900° C.) and 1420° F. (770° C.). However, the kinetics of the cooling process are such that austenite decomposition does not begin in earnest until the mid 1500° F. (815° C.) range and continues somewhat below 1100° F. (595° C.).

Failure to decompose the austenite in the first cooling stage will result in the formation of martensite and/or pearlite. Martensite, if present, will cause an enlargement of the secondary grain size, and the deterioration of the quality of the (110)[001] orientation. Its presence adversely affects energy storage in the second stage of cold rolling, and results in poorer and more variable magnetic quality of the final silicon steel product. Lastly, martensite degrades the mechanical properties, particularly the cold rolling characteristics. Pearlite is more benign, but still ties up carbon in an undesired form.

As indicated above, austenite decomposition begins at about point "C" in the FIGURE and continues to about point "E". At point "D" fine iron carbide begins to precipitate from the carbon-saturated ferrite. Under equilibrium conditions, carbides begin to precipitate from carbon-saturated ferrite at temperatures below 1280° F. (690° C.). However, the actual process requires some undercooling to start precipitation, which begins in earnest at about 1200° F. (650° C.). It will be noted that the austenite decomposition to carbon-rich ferrite and carbide precipitation from the ferrite overlap somewhat. The carbide is in two forms. It is present as an intergranular film and as a fine intragranular precipitate. The former precipitates at temperatures above about 1060° F. (570° C.). The latter precipitates below about 1060° F. (570° C.). The slow cooling first stage, extending from point "C" to point "E" of the FIGURE has a cooling rate of less than 1500° F. (835° C.) per minute, and preferably from about 500° to about 1050° F. (280° to 585° C.) per minute.

The second stage of the cooling cycle, a fast cooling stage, begins at point "E" in the FIGURE and extends to point "G" between 600° and 1000° F. (315° and 540° C.) at which point the strip can be water quenched to complete the rapid cooling stage. The strip temperature after water quenching is 15° ° F. (65° C.) or less, which is shown in the FIGURE as room temperature (75° F. or 25° C.). During the second cooling stage, the cooling rate is preferably from about 2500° to about 3500° F. (1390° to 1945° C.) per minute and preferably greater than 3000° F. per minute (1665° C.) per minute. This assures the precipitation of fine iron carbide.

It will be evident from the above that the entire intermediate anneal and cooling cycle of the present invention is required in the process of obtaining the desired microstructure, and precise controls are critical. The prior art cycle time shown in the FIGURE required at least 3 minutes, terminating in a water bath, not shown, at a strip speed of about 220 feet per minute (57 meters per minute). The intermediate anneal cycle time of the present invention requires about 2 minutes, 10 seconds which enabled a strip speed of about 260 feet per minute (80 meters per minute) to be used. It will therefore be noted that the annealing cycle of the present invention enables greater productivity of the line. No aging treatment after the anneal is either needed or desired, since it has been found to cause the formation of an enlarged secondary grain size which degrades the magnetic quality of the final silicon steel product.

The intermediate anneal is followed by the second stage of cold rolling where the silicon steel is reduced to the desired final gauge. The silicon steel is thereafter decarburized, coated with an annealing separator and subjected to a final anneal to effect secondary recrystallization.

In the plant, two regular grain oriented silicon steel heats having an aim silicon content of 3.15%, were processed. The chemistries for these two heats in weight percent are given in TABLE I below.

TABLE I

| Heat | C | Mn | S | Si | Al | N | Cu |
|---|---|---|---|---|---|---|---|
| A | 0.0280 | 0.0592 | 0.0215 | 3.163 | 0.0016 | 0.0033 | 0.094 |
| B | 0.0288 | 0.0587 | 0.0216 | 3.175 | 0.0013 | 0.0029 | 0.083 |

The processing was without a hot band anneal and each of the two heats were separated and processed to to final gauges of 11 mils (0.28 mm), 9 mils (0.23 mm) and 7 mils (0.18 mm) each using three different intermediate gauges. The three intermediate gauges for each of the 7, 9 and 11 mil (0.18 mm, 0.23 mm and 0.28 mm) materials are given in TABLE II below.

TABLE II

| Final Gauge | Intermediate Gauge (inch) | (mm) |
|---|---|---|
| 7-mil (0.18 mm) | 0.019 | 0.48 |
| | 0.021 | 0.53 |
| | 0.023 | 0.58 |
| 9-mil (0.23 mm) | 0.021 | 0.53 |
| | 0.023 | 0.58 |
| | 0.025 | 0.63 |
| 11-mil (0.28 mm) | 0.022 | 0.56 |
| | 0.024 | 0.61 |
| | 0.026 | 0.64 |

The standard prior art aim gauges for 7 mil (0.18 mm), 9 mil (0.23 mm) and 11 mil (0.28 mm) materials were, respectively, 0.021 inch (0.53 mm), 0.023 inch (0.58 mm), and 0.024 inch (0.61 mm). The silicon steels were given an intermediate anneal and cooling cycle according to the present invention. To this end they were soaked for about 8 seconds at about 1680° F. (915° C.). Thereafter they were cooled to about 1060° F. (570° C.) at a rate of from about 850° to about 1200° F. (from about 470° to about 670° C.) per minute. They were then cooled to about 600° F. (350° C.) at a rate of about 1500° to about 2000° F. (about 830° to about 1100° C.) per minute, followed by water quenching to less than 150° F. (65° C.). The silicon steels were cold rolled to final gauge, decarburized at 1525° F. (830° C.) in wet hydrogen bearing atmosphere, magnesia coated, and given a final box anneal at 2200° F. (1200° C) for 24 hours in wet hydrogen.

The coil front and back average results of both heats A and B are summarized in TABLE III below.

TABLE III

| Intm (inch) | Gauge (mm) | # Cls | P-15 (W/lb) | P-15 (W/Kg) | H-10 |
|---|---|---|---|---|---|
| | | 7-mil (0.18 mm) | | | |
| 0.019 | 0.48 | 6 | 0.387 | .853 | 1843 |
| 0.021 | 0.53 | 6 | 0.386 | .851 | 1844 |
| 0.023 | 0.58 | 6 | 0.382 | .842 | 1846 |
| | | 9-mil (0.18 mm) | | | |
| 0.021 | 0.53 | 6 | 0.423 | .932 | 1847 |
| 0.023 | 0.58 | 6 | 0.417 | .919 | 1848 |
| 0.025 | 0.63 | 6 | 0.413 | .910 | 1849 |
| | | 11-mil (0.18 mm) | | | |
| 0.022 | 0.56 | 4 | 0.481 | 1.060 | 1845 |
| 0.024 | 0.61 | 5 | 0.478 | 1.054 | 1849 |
| 0.026 | 0.64 | 6 | 0.472 | 1.040 | 1848 |

Based upon prior art results, the aim 15 kGa core loss values for the 7-mil (0.18 mm), 9-mil (0.23 mm) and 11-mil (0.28 mm) material, respectively, were 0.390 W/lb (0.867 W/Kg), 0.420 W/lb (0.933 W/Kg) and 0.480 W/lb (1.067 W/Kg). It will be noted that for each of the 7, 9 and 11-mil (0.18 mm, 0.23 mm, and 0.28 mm) materials a slight core loss improvement was achieved at the prior art intermediate gauges. Even greater improvement was achieved at heavier intermediate gauges. This clearly shows that the optimum intermediate gauge has shifted upwardly with the adoption of the intermediate anneal cycle of the present invention. It will be noted that the H-10 permeability also improves at the heavier intermediate gauges.

The present invention has thus far been described in its application to partially austenitic grades of regular grain oriented silicon steel. Fully ferritic grades undergo no transformation from bcc type crystal structure to fcc. This can be determined from the ferrite stability index calculated as:

$$FSI = 2.54 + 40.53*(C+N) + 0.43*(Mn+Ni) + 0.22*Cu - 2.65*Al - 3.95*P - 1.26*(Cr+Mo) - Si$$

Compositions having a value equal to or less than 0.0 are fully ferritic. Increasing positive ferrite stability index values represent increasing volume fractions of austenite will be present. For fully ferritic compositions, rapid cooling can be initiated directly at the end of the soak since there is no austenite present, and thus a stage one slow cooling is not required.

Modifications may be made in the invention without departing from the spirit of it.

What is claimed is:

1. A process for producing regular grain oriented silicon steel having a thickness of from 7 to 18 mils (0.18 to 0.46 mm) comprising the steps of providing a hot band of silicon steel containing in weight percent from about 2.5% to about 4.0% silicon, removing the hot band scale if present, cold rolling to intermediate gauge without an anneal of said hot band, subjecting said intermedia gauge material to an intermediate anneal at a soak temperature from about 1650° F. (900° C.) to about 2100° F. (1150° C.) for a soak time of from about 1 second to about 30 seconds, conducting a slow cooling stage from said soak temperature to a temperature of from about 1000° F. (540° C.) to about 1200° F. (650° C.) at a cooling rate less than 1500° F. (835° C.) per minute, thereafter conducting a fast cooling stage to a temperature of from about 600° F. (315° C.) to about 1000° F. (540° C.) at a rate greater than 1500° F. (835° C.) per minute followed by water quenching, cold rolling said silicon steel to final gauge, decarburizing, coating said decarburized silicon steel with an annealing separator, and subjecting said silicon steel to a final anneal to effect secondary recrystallization.

2. The process claimed in claim 1 wherein said silicon content in weight percent is about 3.15%.

3. The process claimed in claim 1 including the step of conducting said intermediate anneal with a soak time of from about 3 to 8 seconds.

4. The process claimed in claim 1 including the step of conducting said intermediate anneal at a soak temperature of from about 1650° F. (900° C.) to about 1700° F. (930° C.).

5. The process claimed in claim 1 including the step of conducting said intermediate anneal at a soak temperature of about 1680° F. (915° C.).

6. The process claimed in claim 1 including the step of terminating said slow cooling stage at a temperature of about 1100° F.±50° F. (595° C.±30° C.).

7. The process claimed in claim 1 including the step of conducting said slow cooling stage at a cooling rate of from about 500° F. (280° C.) to about 1050° F. (585° C.) per minute.

8. The process claimed in claim 1 including the step of conducting said fast cooling stage at a cooling rate of about 2500° F. (1390° C.) to about 3500° F. (1945° C.) per minute.

9. The process claimed in claim 1 including the steps of conducting said intermediate anneal with a soak temperature of about 1680° F. (915° C.) for a soak time of about 3 to 8 seconds, conducting said slow cooling stage at a cooling rate of about 500° F. (280° C.) to about 1050° F. (585° C.) per minute, terminating said slow cooling stage at a temperature of about 1100° F.±50° F. (595° C.±30° C.), and conducting said fast cooling stage at a rate of from about 2500° F. (1390° C.) to about 3500° F. (1945° C.) per minute.

10. The process claimed in claim 1 wherein said silicon steel consists essentially of, in weight percent, up to about 0.10% carbon, about 0.025% tp 0.25% manganese, about 0.01% to 0.035% sulful and/or selenium, about 2.5% to about 4.0% silicon, less than about 100 ppm aluminum, less than about 50 ppm nitrogen, additions of boron and/or copper, if desired, the balance being essentially iron.

11. The process claimed in claim 9 wherein said weight percent of silicon is about 3.15%.

* * * * *